US005890336A

United States Patent [19]

Kubiak et al.

[11] Patent Number: 5,890,336

[45] Date of Patent: Apr. 6, 1999

[54] BASE SHEET FOR ROOFING ASSEMBLY

[75] Inventors: Mira C. Kubiak, Wayne, N.J.; Harold C. Albo, Jr., Rock Hill, S.C.; Brent L. Grazman, Livingston, N.J.; William D. Lee, Sparta, N.J.; William J. Woodring, Bound Brook, N.J.

[73] Assignee: Building Materials Corporation of America, Wayne, N.J.

[21] Appl. No.: 19,456

[22] Filed: Feb. 5, 1998

[51] Int. Cl.[6] ..... E04D 5/12

[52] U.S. Cl. ..... 52/408; 52/411; 52/673; 428/131

[58] Field of Search ..... 52/408, 411, 673, 52/DIG. 16; 428/131

[56] References Cited

U.S. PATENT DOCUMENTS

| | | | |
|---|---|---|---|
| 638,493 | 12/1899 | Blazo et al. | 52/673 |
| 1,968,246 | 7/1934 | Coleman | 52/506.01 |
| 3,135,069 | 6/1964 | Schuller et al. . | |
| 4,567,079 | 1/1986 | Canfield et al. . | |

*Primary Examiner*—Christopher Kent
*Attorney, Agent, or Firm*—Imre Balogh; William J. Davis

[57] ABSTRACT

Roofing assembly having a substrate covered with a base sheet which is perforated with a plurality of uniformly spaced clusters of vertical apertures designed to receive an adhesive to bond the base sheet to the substrate. The roofing assembly possesses improved wind uplift resistance.

18 Claims, 2 Drawing Sheets

FIG. 1B

BASE SHEET FOR ROOFING ASSEMBLY

BACKGROUND OF THE INVENTION

1. Field of the Invention

This invention relates to a base sheet for a roofing assembly wherein the base sheet is perforated by a plurality of a cluster of apertures for allowing the flow of an adhesive therethrough for bonding the base sheet to an underlying substrate.

2. Reported Developments

A roofing assembly typically comprises: a substrate or deck having an interior surface facing the internal area of the building, and an exterior surface; an insulating layer or sheet covering the exterior surface; a base sheet covering the insulating layer and rendering the underlying assembly impervious to the elements but allowing for the breathing out of moisture which might be trapped in the underlying assembly; a membrane and a surface or finishing layer on top of the membrane completing the roofing assembly.

The substrate or deck can be made of gypsum, cement, wood, metals or a synthetic material sufficient to provide structural integrity to the roofing assembly.

The insulating layer is constructed of a rigid or semi-rigid material to reduce thermal fluctuation and includes such materials as Perlite, polystyrene, polyurethane, isocyanurate, fiber boards and foam glass.

The base sheet is composed of an organic or inorganic material, saturated or coated with oxidized or unoxidized asphalt, polymer modified asphalt or coal tar. The top and under surfaces of the base sheet are coated with an asphaltic material in which granules or particulates are embedded to allow ventilation therethrough. The base sheet is contacted with a release agent, such as sand, talc or a soap to prevent sticking between the layers when the layers are formed into rolls for shipping.

The base sheet is perforated in order to provide a plurality of holes for allowing penetration of a flowable bonding agent so that the base sheet may be bonded to the underlying substrate. Such bonding agents include asphalts and coal tar pitch having softening points of from about 100° to about 500° F. The bonding material may contain a mineral stabilizer, such as that derived from limestone, stone powder, sand or other fine mineral particles. At the point of application, the bonding agent is heated to a flowable condition. The heated bonding agent flows through the perforations and bond the base sheet to the substrate at the point of perforations in the marginal areas thereof, while the unbounded areas between the perforations allow for venting of vapors which may build up due to changes in temperature and humidity. The marginal areas of perforations where the bonding agent secures the base sheet to the underlying substrate insures against wind uplift, i.e., to prevent the separation of the base sheet from the underlying surface.

A persistent problem associated with roofing assembly, especially during the process of construction thereof, is wind uplift which results in the separation of the base sheet from the underlying substrate. In areas of high wind velocity and during construction under inclement weather condition it has been difficult to achieve the wind uplift resistance without using cost prohibitive construction techniques. Convenient and inexpensive methods were taught in the prior art for example, as disclosed in U.S. Pat. Nos. 3,135,069 and 4,567,079 in which the base sheet carries a plurality of uniformly sized and spaced apertures or perforations which allow flowthrough of a bonding agent to secure the base sheet to the underlying substrate.

While this method is cost and time saving in that it eliminates the need for securing devices at critical intervals, it has not been found effective in environments subject to relatively high wind velocities since the base sheets containing a plurality of uniformly spaced perforations currently available do not provide sufficient adhesive force when a bonding agent is flown therethrough and sheet integrity to resist strong wind uplift forces. In the case of a conventionally perforated base sheet, merely widening the circular perforations or increasing their number is not a viable solution since these approaches decrease the strength of the base sheet.

Accordingly, it is an object of the present invention to provide an improved base sheet having uniquely positioned apertures therein for attachment of the base sheet to an underlying substrate by the use of a flowable bonding substance.

It is a main object of the present invention to provide a roofing assembly comprising a base sheet having uniquely positioned apertures therein which, as part of the roofing assembly, has superior resistance to wind uplift forces.

These and other objects and advantages will be more apparent from the description that follows.

SUMMARY OF THE INVENTION

A flexible base sheet designed to be adhesively attached to a substrate is provided comprising:

an organic or inorganic material, saturated or coated with oxidized or unoxidized asphalt, polymer modified asphalt or coal tar in which granules or particulates are embedded wherein the flexible base sheet is provided with a plurality of a cluster of apertures wherein each cluster contains from two to ten apertures, preferably from two to six apertures, and most preferably three apertures.

In a preferred embodiment the base sheet is a moisture resistant and flame retardant inorganic base sheet, asphalt coated on both sides and surfaced on the bottom side with mineral granules with a series of three closely spaced 0.5" diameter circular perforations spaced on 4.0" centers. The granules on the bottom side of the base sheet provide the venting system and the cluster perforations allows good attachment to the substrate without interfering with the venting. When asphalt or other suitable hot melt agent is hot mopped on the top of the perforated base sheet, it flows through the perforations and firmly bonds the perforated base sheet, and subsequent plies, to the underlying substrate with uniform spot attachment. The granules on the underside of the perforated base sheet provide a consistent and uniform pattern for lateral movement of trapped gasses, including moisture vapor.

BRIEF DESCRIPTION OF TE DRAWINGS

The drawings show the various embodiments of the perforated base sheet of the present invention wherein the perforations are arranged in clustered groupings.

DETAILED DESCRIPTION OF THE INVENTION

The present invention is based on the discovery that certain cluster of aperture structures which are different from those used or suggested by the prior art provides the benefit of increased bonding strength between the base sheet and the underlying substrate without weakening the integrity of the base sheet when the base sheet is bonded to the substrate by an adhesive. The increased bonding strength renders the base sheet and the underlying substrate to which it is bonded wind uplift resistance.

During extensive experimentation it has been observed that a base sheet having uniformly spaced circular shape apertures offers insufficient peripheral dimensions for a given enclosed area: the adhesive penetration into the substrate surrounding the aperture site is limited by the perimeter of the aperture. Increasing the perimeter of the circular shape aperture by perforating the base sheet with large diameter apertures weakens the integrity of the base sheet. Lengthening the perimeter of the aperture relative to its enclosed area by deviation from the circular shape aperture, such as by using slots, grooves and various non-circular shapes, greatly increases manufacturing cost.

Reference is now made to the drawings showing the various embodiments of the perforated base sheet.

In the various embodiments described herein the aperture clusters are uniformly spaced on the base sheet and are usually inset from the longitudinal marginal edges of the base sheet by from about 1 to about 6 inches depending in part on the size of the base sheet and the type of roofing assembly. The aperture clusters are spaced from each other of from by 3 to 7 inches. The size of an individual aperture is of from about 0.25 to about 5.0 inches, preferably of from about 0.5 to about 2.0 inches. The cluster can comprise two or more apertures. In a particularly preferred embodiment, the cluster comprises three apertures.

The width of the base sheet is generally about 24, 36, 40 or 48 inches, the 40 inches (1 meter) is preferred. The thickness of the base sheet can vary of from about 1 to about 5 mm or more, preferably the thickness is of from about 1.5 to about 3 mm.

Based on the cluster configurations the rows of apertures are spaced one from the other by a distance effective to adhere the undersurface of the base sheet to the underlying substrate. The apertures within each cluster can be disposed in a linear or geometric pattern or can be randomly disposed.

Figure 1A:
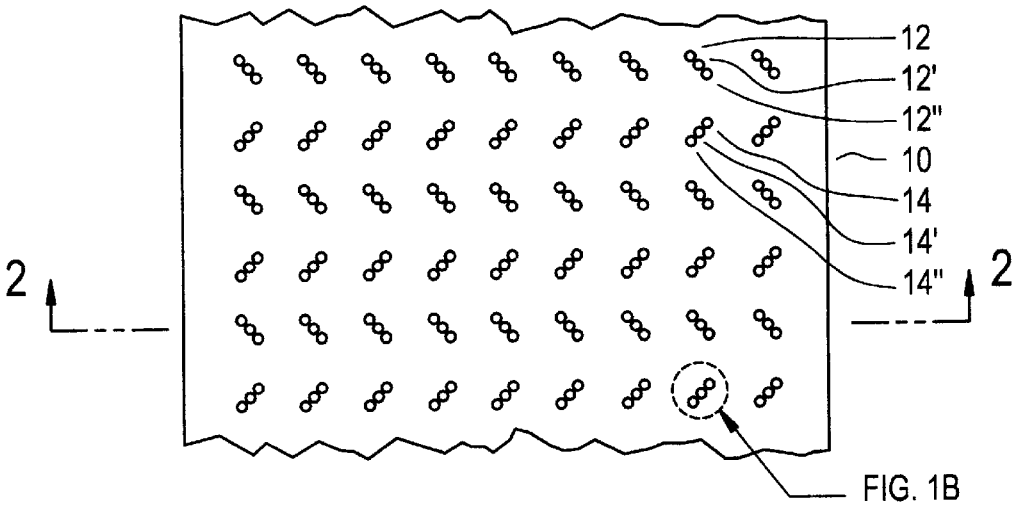
FIG. 1 is a top plan view of a base sheet 10 uniformly apertured with three-cluster perforations.
Figure 1B:
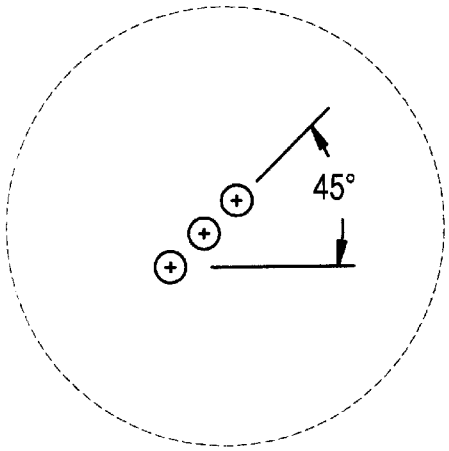

FIG. 1 shows a three-cluster perforation embodiment of base sheet 10 wherein one set of cluster perforations 12, 12' and 12" are oriented at about 45° of the longitudinal or length direction of the base sheet, while the other set of cluster perforations 14, 14' and 14" are oriented at about 135° of the longitudinal or length direction of the base sheet.

Figure 2:
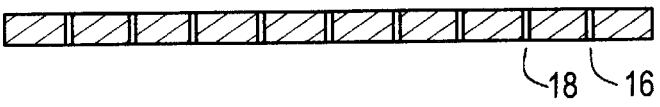
FIG. 2 is a cross-sectional view of the base sheet in its longitudinal or length direction taken along the line 2–2' of FIG. 1.

The perforations run from the top surface to the bottom surface of the base sheet defining a plurality of cylindrical voids 16 and 18 as illustrated in FIG. 2.

Figure 3:
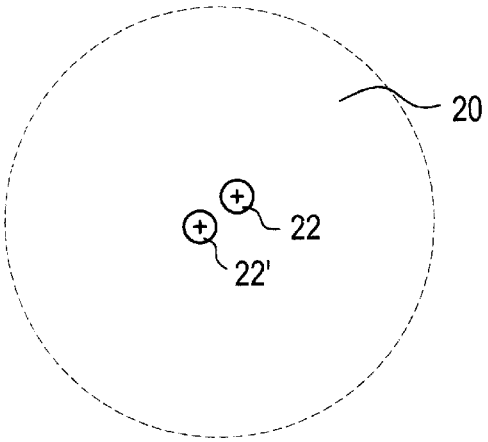
FIG. 3 is a top plan view of a portion of base sheet 20 uniformly apertured with two-clustered perforations.

FIG. 3 shows a two-cluster perforation embodiment of base sheet 20 wherein one set of cluster perforations 22 and 22' are oriented at about 45° of the longitudinal or length direction of the base sheet. Another set of cluster perforations can be oriented at about 135° of the longitudinal or length direction of the base sheet. The perforations run from the top surface to the bottom surface of the base sheet defining a plurality of cylindrical voids.

Figure 4:
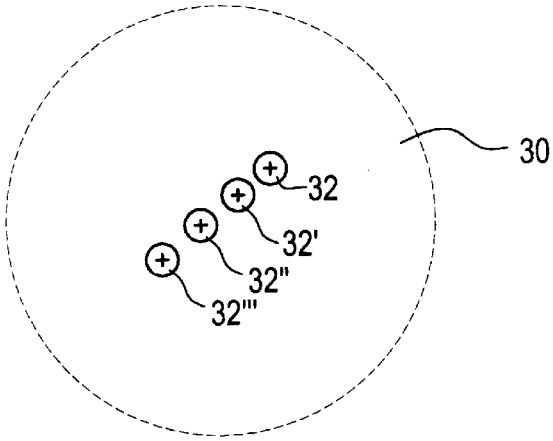
FIG. 4 is a top plan view of a portion of base sheet 30 uniformly apertured with four-cluster perforations.

FIG. 4 shows a four-cluster perforation embodiment of base sheet 30 wherein one set of cluster perforations 32, 32', 32Δ and 32'" are oriented at about 45° of the longitudinal or length direction of the base sheet. Another set of cluster perforations can be oriented at about 135° of the longitudinal or length direction of the base sheet. The perforations run from the top surface to the bottom surface of the base sheet defining a plurality of cylindrical voids.

Figure 5:
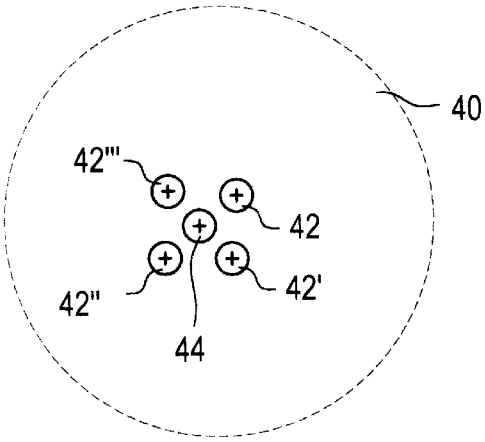
FIG. 5 is a top plan view of a portion of base sheet 40 uniformly apertured with five-cluster perforations.

FIG. 5 shows a five-cluster perforation embodiment of base sheet 40 wherein four perforations 42, 42', 42" and 42'" are at the corners of an imaginary rectangle and one perforation 44 is in the center of the rectangle equidistant from the four perforations. This five-cluster configuration may also be viewed as if the individual perforations ran in rows on an imaginary line which forms a degree of from about 20° to about 45° to the longitudinal or length direction of the base sheet. The perforations run from the top surface to the bottom surface of the base sheet defining a plurality of cylindrical.

Figure 6:
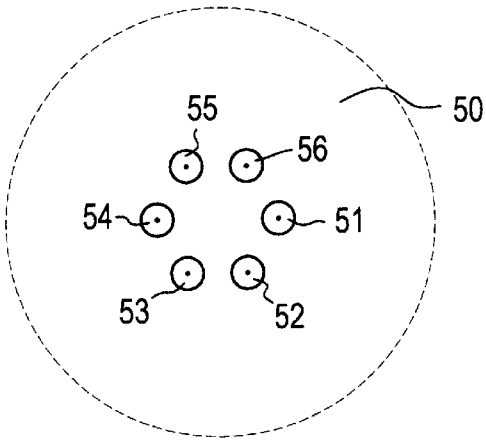
FIG. 6 is a top plan view of a portion of base sheet 50 uniformly apertured with six-cluster perforations wherein the configuration of a cluster resembles a benzene ring oriented in a latitudinal or width direction.

FIG. 6 shows a six-cluster perforation embodiment of base sheet 50 wherein the perforations 51, 52, 53, 54, 55 and 56 are at the six corners of an imaginary benzene ring. An imaginary line connecting corners 51 and 54 is oriented in a latitudinal or width direction. The perforations run from the top surface to the bottom surface of the base sheet defining a plurality of cylindrical voids.

Testing for Wind Uplift Resistance

Samples of the present invention were tested for wind uplift resistance.

Several 24" by 24" non-perforated base sheets, composed of a fiberglass non-woven core saturated with filled, oxidized asphalt were modified by forming a plurality of perforations therein. The perforations were as follows.

Controls

1a) Conventional ⅝" circular perforations on 3 inch centers.

1b) Perforation slots having a ¼"×1.5" area.

Test Samples

2) Three ½" diameter perforations the centers of which are spaced from each other at a distance of ⅝".

3) Three ½" diameter perforations the centers of which are spaced from each other at a distance of ¾".

4) Two ½" diameter perforations the centers of which are spaced from each other at a distance of ¾".

5) Two ½" diameter perforations the centers of which are spaced from each other at a distance of 1".

The control base sheets and the sample base sheets were cut to 3"×3" pieces and placed on 3"×3" plywood and adhered to the plywood by applying a thin layer of viscous mopping asphalt on top of the base sheets. The controls and the samples were allowed to cool and then were tested on Instron, i.e., the assembly was pulled with 2"/min jaw separation speed and the maximum load was recorded as uplift resistance. The result is shown in Table I.

TABLE I

Uplift Resistance of Alternate Perforations Patterns

| Test # | 1a | 1b | 2 | 3 | 4 | 5 |
|---|---|---|---|---|---|---|
| Pattern 3" | ⅝" holes on on centers/control | ¼" × 1.5" slot/control | Three ½" holes on ⅝" centers | Three ½" holes on ¾" centers | Two ½" holes on ¾" centers | Two ½" holes on 1" centers |
| Specimen # | | | | | | |
| 1 | 145 | 164 | 267 | 191 | 162 | 139 |
| 2 | 152 | 197 | 423 | 125 | 199 | 168 |
| 3 | 149 | 165 | 268 | 202 | 142 | 128 |
| 4 | 155 | 187 | 223 | >208 | 111 | 173 |
| 5 | | | | 191 | | |
| | | | | >251 | | |
| AVG (lbs/ft$^2$) | 150 | 179 | 295 | >195 | 154 | 152 |

Similar improvements of wind lift-up resistance were obtained with other cluster configuration apertures described herein.

Having described the invention with reference to its preferred embodiments, it is to be understood that modifications within the scope of the invention will be apparent to those skilled in the art.

What is claimed is:

1. In a roofing assembly having a substrate the improvement which comprises:

a base sheet defined by longitudinal length, latitudinal width and thickness having a top surface and a bottom surface covering said substrate, said base sheet having a plurality of uniformly spaced clusters of vertical apertures therein, each aperture being of cylindrical configuration running from said top surface to said bottom surface designed to receive an adhesive to bond said base sheet to said substrate.

2. The roofing assembly of claim 1 wherein each of said clusters comprises two apertures.

3. The roofing assembly of claim 2 wherein the two apertures are oriented at about 45° of the longitudinal length of the base sheet, followed by two apertures oriented to about 135° of the longitudinal length of the base sheet.

4. The roofing assembly of claim 1 wherein each of said clusters comprise three apertures.

5. The roofing assembly of claim 4 wherein the apertures are oriented at about 45° of the longitudinal length of the base sheet, followed by three apertures oriented at about 135° of the longitudinal length of the base sheet.

6. The roofing assembly of claim 1 wherein each of said clusters comprises four apertures.

7. The roofing assembly of claim 6 wherein four apertures are oriented at about 45° of the longitudinal length of the base sheet, followed by four apertures oriented at about 135° of the longitudinal length of the base sheet.

8. The roofing assembly of claim 1 wherein each of said clusters comprises five apertures.

9. The roofing assembly of claim 8 wherein four of said apertures are positioned at the corners of a rectangle and one of the apertures is positioned in the center of the rectangle equidistant from said four apertures.

10. The roofing assembly of claim 1 wherein each of said clusters comprises six apertures.

11. The roofing assembly of claim 10 wherein the apertures are positioned at the corners of a benzene ring configuration in which two opposing corners are oriented in the latitudinal width of the base sheet.

12. The roofing assembly of claim 10 wherein the apertures are positioned at the corners of a benzene ring configuration in which two opposing corners are oriented in the longitudinal length of the base sheet.

13. The roofing assembly of claim 1 wherein the substrate is a roof deck.

14. The roofing assembly of claim 1 wherein the substrate is an insulation layer.

15. The roofing assembly of claim 1 wherein the base sheet is coated on the bottom surface thereof in which granules are embedded to allow flow of vapor between the base sheet and the substrate.

16. The roofing assembly of claim 1 wherein the width of the base sheet is of from about 24 to about 48 inches.

17. The roofing assembly of claim 1 wherein the thickness of the base sheet is of from about 1 to about 5 mm.

18. The roofing assembly of claim 1 wherein the diameter of each aperture is of from about 0.25 to about 1.5 mm.

* * * * *